US008768190B2

(12) United States Patent
Oba

(10) Patent No.: US 8,768,190 B2
(45) Date of Patent: Jul. 1, 2014

(54) DEVELOPING DEVICE

(75) Inventor: Hiroyuki Oba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 469 days.

(21) Appl. No.: 12/794,963

(22) Filed: Jun. 7, 2010

(65) Prior Publication Data

US 2010/0316402 A1 Dec. 16, 2010

(30) Foreign Application Priority Data

Jun. 11, 2009 (JP) ..... 2009-140346
Mar. 30, 2010 (JP) ..... 2010-077906

(51) Int. Cl.

| | |
|---|---|
| ***G03G 15/06*** | (2006.01) |
| ***G03G 15/08*** | (2006.01) |
| ***G03G 15/095*** | (2006.01) |
| ***G03G 15/09*** | (2006.01) |

(52) U.S. Cl.

USPC ..... 399/55; 399/235; 399/260; 399/264; 399/274; 399/284

(58) Field of Classification Search

USPC ..... 399/30, 55, 234, 235, 249, 260, 264, 399/273, 274, 284, 285

See application file for complete search history.

(56) References Cited

U.S. PATENT DOCUMENTS

| | | | | |
|---|---|---|---|---|
| 5,781,827 | A * | 7/1998 | Shimada et al. | 399/55 |
| 2002/0191981 | A1* | 12/2002 | Miyabe et al. | 399/90 |
| 2005/0158061 | A1* | 7/2005 | Do | 399/44 |

FOREIGN PATENT DOCUMENTS

| | | |
|---|---|---|
| JP | 8-114977 A | 5/1996 |
| JP | 2003-66716 A | 3/2003 |

* cited by examiner

*Primary Examiner* — Joseph S Wong

(74) *Attorney, Agent, or Firm* — Fitzpatrick, Cella, Harper & Scinto

(57) ABSTRACT

A developing device includes a developer bearing member for bearing a developer so as to develop an electrostatic image, a restricting member for restricting the amount of developer born on the developer bearing member, a detector for detecting information on the amount of developer existing between the developer bearing member and the restricting member, and a controller which can change a value of a voltage to be applied to the restricting member during image formation based on a result detected by the detector.

8 Claims, 12 Drawing Sheets

DEVELOPING DEVICE

BACKGROUND OF THE INVENTION

1. Field of the Invention

The present invention relates to a developing device for use in an image forming apparatus for forming an image on a member to be transferred by an electrophotographic system.

2. Description of the Related Art

An image forming apparatus adopting an electrophotographic system has been conventionally put to practical use. Such an image forming apparatus has been required to achieve a higher quality of an image inclusive of durable stability in recent years. "The durable stability" herein can be rephrased with little variation of a quality of an image from the beginning of the use of the image forming apparatus until expiration of its lifetime. In order to maintain "the durable stability" on an appropriate level, it is important to hold the amount of developer borne on a developer bearing member (hereinafter referred to as toner coat amount) at a proper value from the beginning of the use of the image forming apparatus until the expiration of its lifetime of an apparatus body.

FIG. 11 shows the configuration for restricting the toner coat amount on a developer bearing member 143 in a conventional image forming apparatus. As shown in FIG. 11, the image forming apparatus includes a restricting member 145 for restricting, to a predetermined value, the toner coat amount of developer 147 borne on the developer bearing member 143 (including a magnet roller 146 therein) in contact with the surface. The restricting member 145 abuts against the developer bearing member 143 in a direction counter to the rotational direction (i.e. a Z direction) of the developer bearing member 143, so that a thin layer is formed on a surface of the developer bearing member 143 with the developer in the predetermined toner coat amount. Incidentally, Japanese Patent Application Laid-open No. 2003-66716 discloses a configuration for controlling a toner coat amount using such a restricting member.

However, the image forming apparatus in the prior art has raised the following problems to be solved.

As the image forming apparatus is more frequently used for a longer period of time, the surface roughness of the developer bearing member is reduced due to abrasion, so that the developer is hardly borne. As a consequence, the toner coat amount borne on the developer bearing member is reduced. Since the abutment pressure or fixing position of the restricting member is varied according to the dimensional or fixing tolerance of a part per se, the toner coat amount is fluctuated accordingly. On the other hand, there has been conventionally disclosed a technique for applying a voltage to a restricting member and controlling the voltage, so as to adjust a toner coat amount.

However, although the conventional image forming apparatus can adjust an increase or decrease in toner coat amount, it does not take the toner coat amount before adjustment into consideration, and therefore, it cannot always correct the toner coat amount to a predetermined quantity. Consequently, in the case where the amount of developer borne on a developer bearing member is fluctuated, an image density or the like also is fluctuated, thereby raising a problem to be solved that a good quality of an image cannot be stably achieved.

SUMMARY OF THE INVENTION

The present invention has been accomplished to solve the above-described problems experienced in the prior art. Therefore, an object of the present invention is to provide an image forming apparatus capable of stably achieving a good quality of an image even if the amount of developer borne on a developer bearing member is varied.

A developing device for achieving the above-described object includes a developer bearing member for bearing the developer so as to develop the electrostatic image, a restricting member for restricting the amount of developer borne on the developer bearing member, a detector for detecting information on the amount of developer existing between the developer bearing member and the restricting member, and a controller which can change a value of a voltage to be applied to the restricting member during image formation, based on a result detected by the detector.

A developing device for achieving the above-described object in another aspect includes a developer bearing member for bearing the developer so as to develop the electrostatic image, a restricting member for restricting the amount of developer borne on the developer bearing member, a detector for detecting information on the amount of developer existing between the developer bearing member and the restricting member, and a controller which can change a value of a voltage to be applied to the developer bearing member during image formation, based on a result detected by the detector.

Further features of the present invention will become apparent from the following description of exemplary embodiments with reference to the attached drawings.

DETAILED DESCRIPTION OF THE EMBODIMENTS

A detailed description will be illustratively given below of embodiments carrying out the present invention with reference to the attached drawings. Here, the dimensions, materials, shapes, and relative arrangements of constituent parts described in the embodiments below are not to limit the scope of the present invention, unless specially stated.

[First Embodiment]

(Schematic Configuration of Image Forming Apparatus)

Figure 2:
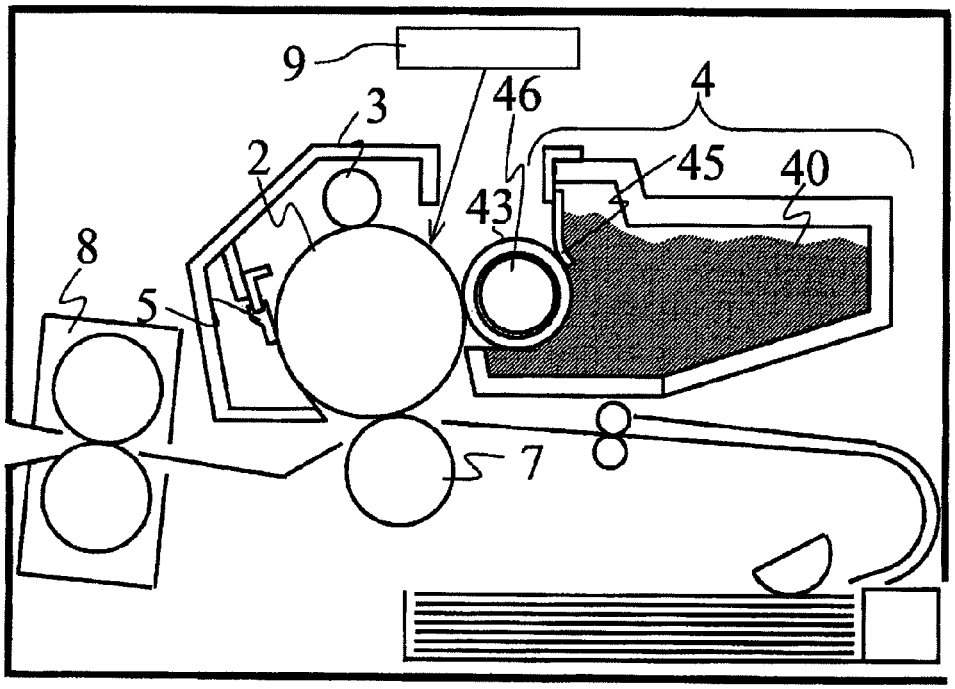
FIG. 2 is a view schematically showing the configuration of an image forming apparatus according to the first embodiment.

Referring to FIG. 2, a description will be given of the schematic configuration of an image forming apparatus according to a first embodiment of the present invention. The image forming apparatus according to the present embodiment is a laser beam printer adopting an electrophotographic system. The image forming apparatus includes a rotatable photosensitive drum 2 serving as an image carrier, a charging roller 3 for uniformly charging the surface of the photosensitive drum 2, and a cleaning blade 5 for cleaning the surface of the photosensitive drum 2. Moreover, at a position facing the photosensitive drum 2 a developing device 4 is provided for supplying a toner (i.e., a developer) onto the photosensitive drum 2. Here, the number of developing devices 4 is not limited to one, and therefore, a plurality of developing devices 4 may be disposed for different kinds of toners (Y, M, C, and K).

The developing device 4 includes a rotatable developing sleeve 43 (i.e., a developer bearing member) which bears thereon a toner 40 to be supplied onto the photosensitive drum 2 and is made of aluminum, and a magnet roller 46 disposed inside of the developing sleeve 43. A magnetic toner is used as the developer in the present embodiment. Since the magnet roller 46 is disposed inside of the developing sleeve 43, the toner can efficiently adhere onto the developing sleeve 43. The developing device 4 further includes a conductive restricting blade 45 (i.e., a restricting member) whose one end is fixed to a frame of the developing device 4 whereas whose other end abuts against the surface of the developing sleeve 43 so as to control a toner coat amount (i.e., the amount of developer) existing on the developing sleeve 43. The restricting blade 45 includes a conductive urethane rubber.

In forming an image on a sheet member, first, a signal indicating "print start" is input into an input unit, not illustrated, thereby starting drive of a main motor. The main motor is used for rotating the image carrier or driving the developing device (for example, rotationally driving the developer bearing member). Thereafter, upon input of a signal indicating "image formation start," a laser beam is emitted from an exposing device 9, so that the surface of the photosensitive drum 2, which is uniformly charged by the charging roller 3, is scanned by the laser beam and is exposed to the laser beam, thus forming an electrostatic latent image (i.e., an electrostatic image) on the surface. Then, a development voltage is applied to the developing sleeve 43, so that the toner borne on the developing sleeve 43 is electrostatically supplied onto the electrostatic latent image formed on the photosensitive drum 2, and thus, the electrostatic latent image is developed as a toner image (i.e., a developer image). A transfer voltage is applied to a transfer roller 7, so that the toner images developed on the photosensitive drum 2 are sequentially transferred onto the sheet members (i.e., members to be transferred) which are fed from a feed unit. Subsequently, the transferred toner image is fixed onto the sheet member by heating and pressurizing in a fixing device 8. Through the above-described processes, the image is formed on the sheet member. Although the toner image is transferred directly onto the sheet member from the surface of the photosensitive drum 2 in the present embodiment, an intermediate transfer system may be adopted to temporarily transfer the toner image onto an intermediate transfer belt or the like. In the case of the intermediate transfer system, the intermediate transfer belt serves as "a member to be transferred".

(Schematic Configurations of Developing Sleeve and Restricting Blade)

Figure 1:
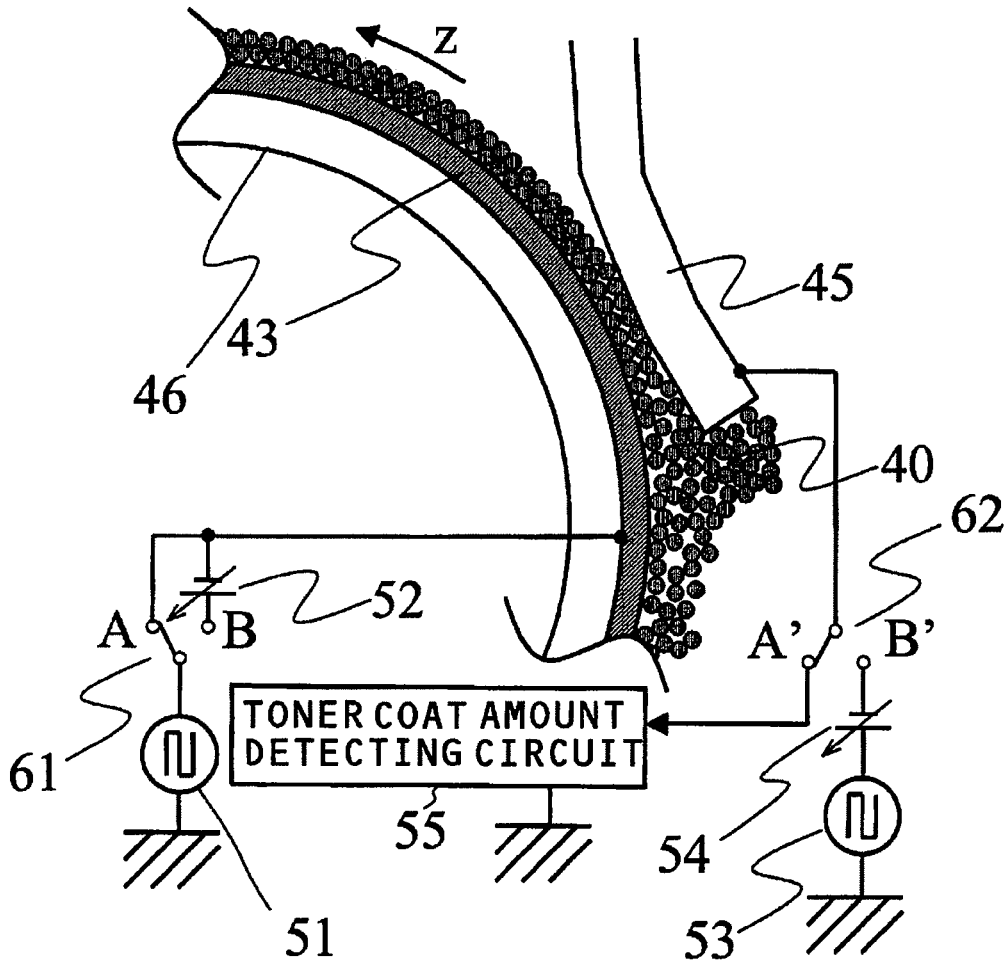
FIG. 1 is a view schematically showing the configurations of a developer bearing member and a restricting member in a first embodiment.

Referring to FIG. 1, explanation will be made on the schematic configurations of the developing sleeve 43 and the restricting blade 45 in the present embodiment. FIG. 1 shows an enlarged view of the abutment portion of the restricting blade 45 against the developing sleeve 43.

The toner borne on the developing sleeve 43 by the magnetic force of the magnet roller 46 is pushed into a space defined between the restricting blade 45 and the developing sleeve 43 as the developing sleeve 43 rotates in a direction indicated by an arrow z, and thus, a thin layer consisting of the toner is formed. Here, the amount of toner (i.e., the developer amount) borne on the developing sleeve 43 is referred to as "a toner coat amount." "The toner coat amount" herein indicates a toner amount per unit area of the toner thin layer on the developing sleeve 43, and is based on a unit of (g/m2).

An AC power source 51 is connected to the developing sleeve 43 via a switch 61. With this configuration, when the switch 61 is turned onto a side A, an AC voltage is applied from the AC power source 51 whereas when the switch 61 is turned onto a side B, a development voltage obtained by superimposing the AC voltage and a DC voltage output from the AC power source 51 and a DC power source 52, respectively, is applied to the developing sleeve 43. Here, the developing sleeve 43, to which the voltage is applied, serves as a first electrode.

In the meantime, the restricting blade 45 is connected to either one of an AC power source 53 and a toner coat amount detecting circuit 55 via another switch 62. With this configuration, when the switch 62 is turned onto a side A', the restricting blade 45 is connected to the toner coat amount detecting circuit 55 (described later). In this case, the restricting blade 45 functions as an output electrode member (i.e., a second electrode) for outputting an electric signal to the toner coat amount detecting circuit 55. In contrast, when the switch 62 is turned onto a side B', a blade voltage obtained by superimposing the AC voltage and a DC voltage output from the AC power source 53 and a DC power source 54, respectively, is applied to the restricting blade 45. In this way, the restricting blade 45 functions as an input electrode member (i.e., the second electrode).

(Relationship between Blade Voltage to be applied to Restricting Blade and Increase/Decrease in Toner Coat Amount)

In the present embodiment, the toner coat amount is detected in a state in which no blade voltage is applied (hereinafter referred to as an original status), and then, the blade voltage is controlled to a target value based on the detected toner coat amount, thus achieving a desired toner coat amount. Consequently, it is possible to provide the image forming apparatus capable of stably achieving a good quality of an image from the beginning of use to expiration of its lifetime.

The relationship between the blade voltage to be applied to the restricting blade 45 and an increase or decrease in toner coat amount will be explained with reference to FIGS. 5A and 5B. The following explanation will be made on the case where a toner charged to a negative polarity is used (the charging polarity of the toner for use in the present embodiment is not limited to this).

The plus/minus of the blade voltage depends upon the comparison with a DC component of the development voltage. As described above, the blade voltage obtained by superimposing the AC voltage and the DC voltage is applied to the restricting blade 45. Here, in the case where the DC component is equal to that of the development voltage, a difference in voltage is assumed to be "zero." In the same manner, in the case where the DC component of the blade voltage is shifted closer to a plus side than the DC component of a development bias, the difference in voltage therebetween is "plus" in contrast, "minus," vice versa.

Figure 5A:
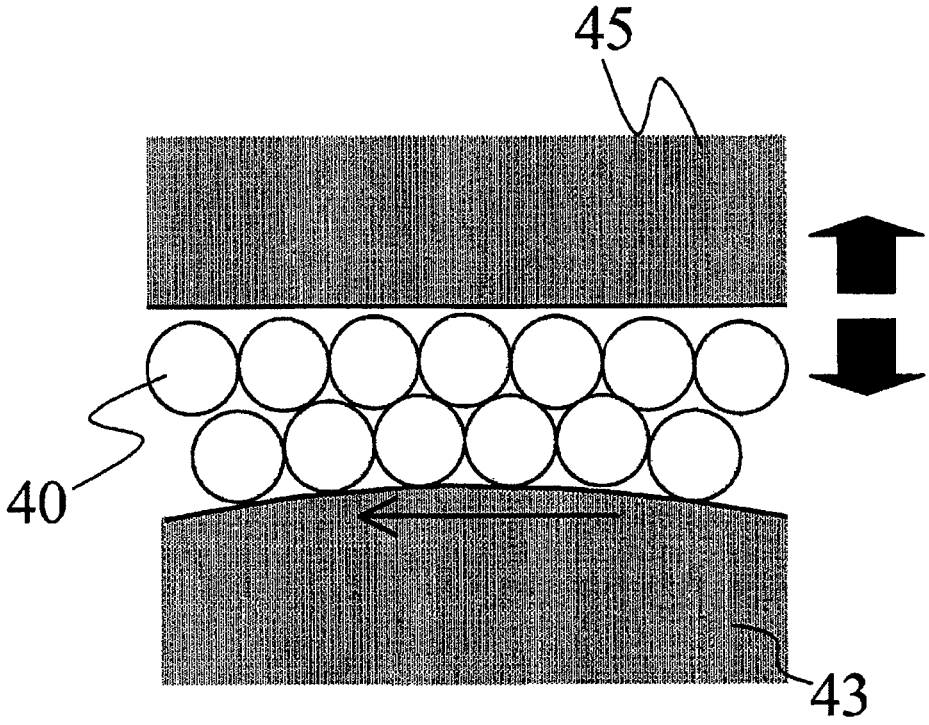
FIGS. 5A and 5B are views showing restriction of the toner coat amount by the restricting member.

First as shown in FIG. 5A, when the DC component of the blade voltage is turned to the negative (minus) side by the DC power source 54 (see FIG. 1), repulsion acts between the restricting blade 45 and a negatively charged toner 40. And then, the toner 40 on the restricting blade 45 will move to be separated from the restricting blade 45 by the repulsion, so that a friction force generated between the toner 40 and the restricting blade 45 is reduced. As a consequence, when the developing sleeve 43 is rotated to transport the toner 40, the toner 40 on the restricting blade 45 is slidably moved on the restricting blade 45 at substantially the same speed as a movement speed of the developing sleeve 43. In other words, the toner coat amount is increased.

Figure 5B:
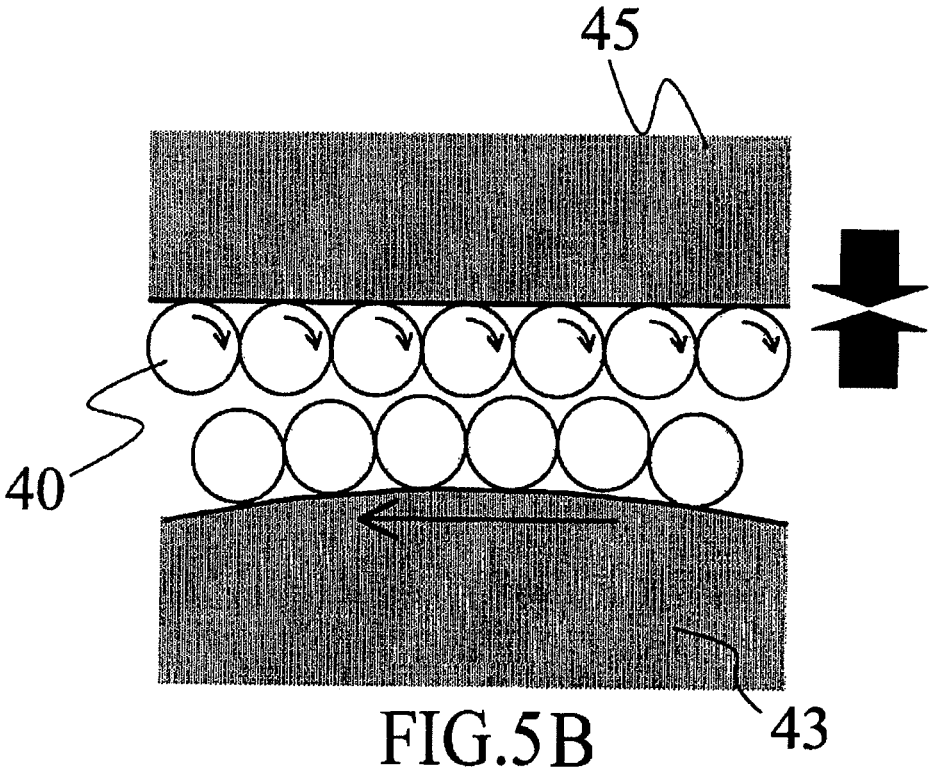

In contrast, as shown in FIG. 5B, when the DC component of the blade voltage is turned to the positive (plus) side by the DC power source 54 (see FIG. 1), an attractive force acts between the restricting blade 45 and the negatively charged toner 40. Then, the toner 40 on the restricting blade 45 is pressed against the restricting blade 45 by the attractive force, so that a friction force generated between the toner 40 and the restricting blade 45 is increased. As a consequence, even if the developing sleeve 43 is rotated to transport the toner 40, the toner 40 on the restricting blade 45 cannot slide on the restricting blade 45 due to the high friction force, and thus, is moved on the restricting blade 45 while being rotated. Naturally, the movement speed of the toner 40 on the restricting blade 45 in this case is smaller than that in the case where the toner 40 slides on the restricting blade 45. That is to say, the number of toner particles passing during a unit period of time is decreased, and therefore, the toner coat amount on the developing sleeve 43 is reduced.

Figure 6:
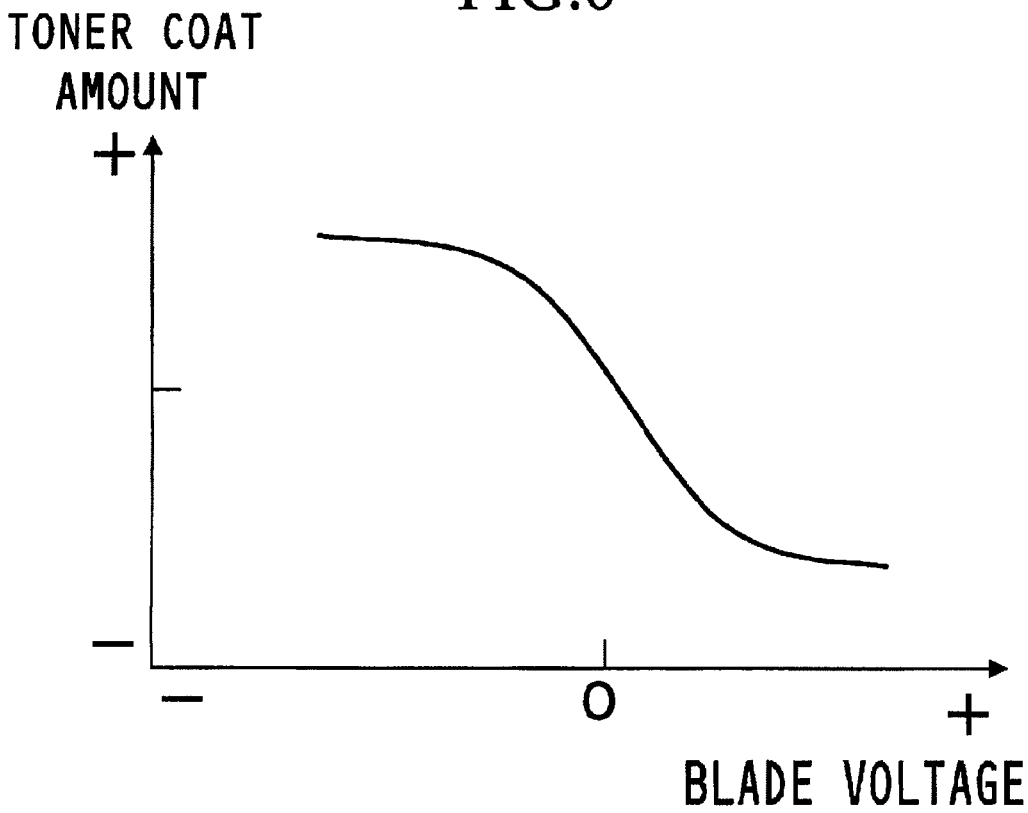
FIG. 6 is a graph illustrating the relationship between the toner coat amount and a voltage to be applied to the restricting member.

FIG. 6 illustrates the relationship between the toner coat amount and the blade voltage to be applied to the restricting blade 45 (i.e., a difference of the development voltage from the DC component). As is obvious from FIG. 6, as the blade voltage approaches more minus, the toner coat amount on the developing sleeve 43 is increased; to the contrary, as the blade voltage approaches more plus, the toner coat amount on the developing sleeve 43 is decreased. Incidentally, in the case that a positively charged toner is used, the relationship becomes reverse to this.

Although the relative increase/decrease in toner coat amount can be adjusted in the case where the blade voltage to be applied to the restricting blade 45 is controlled, the absolute value of the toner coat amount cannot always be adjusted to a desired value. In view of this, the present embodiment is featured in that the toner coat amount in an original status is detected, and the blade voltage to be applied to the restricting blade 45 is controlled based on the detection result. Explanation will be made below on a method for detecting the toner coat amount in the original status.

(Method for Detecting Toner Coat Amount)

Figure 3:
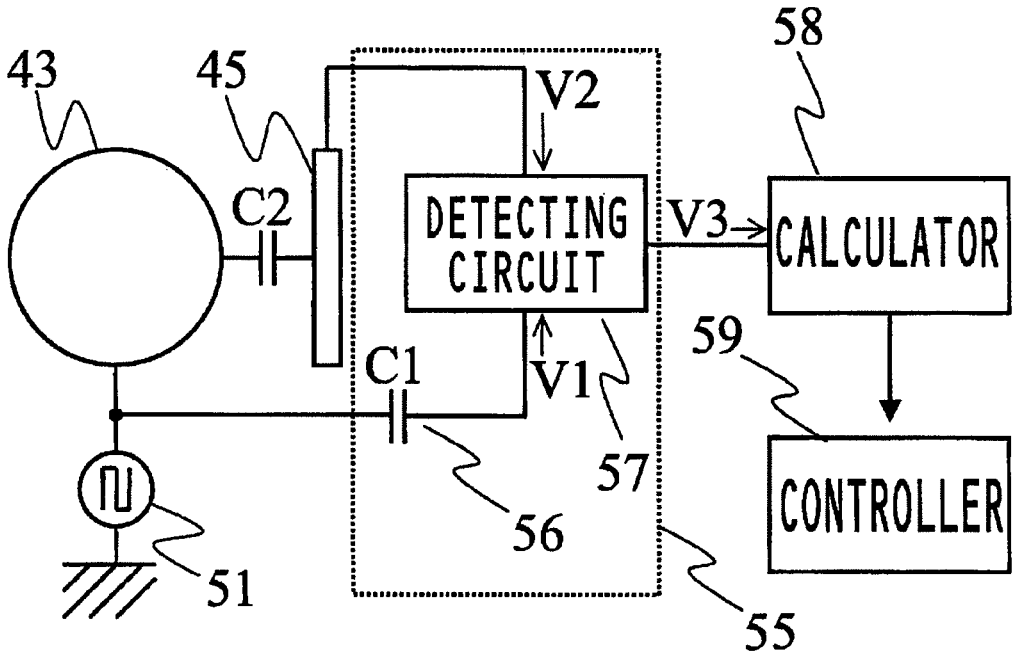
FIG. 3 is a view schematically showing the configurations of the developer bearing member and the restricting member in the first embodiment.

Referring to FIG. 3, a description will be given of the method for detecting the toner coat amount. FIG. 3 illustrates the circuit configuration of the toner coat amount detecting circuit (a detector) 55 shown in FIG. 1. The restricting blade 45 forms a thin layer consisting of the toners in abutment against the developing sleeve 43. The present embodiment is featured in that the restricting blade 45 has also the function as a toner coat amount detecting electrode member by utilizing the restricting blade 45 being conductive.

In detecting the toner coat amount on the developing sleeve 43, first, the AC power source 51 applies the AC voltage (i.e., a detecting vibration voltage) to the developing sleeve 43. At this time, the switch 61 shown in FIG. 1 is turned onto the side A. When the AC voltage is applied to the developing sleeve 43, a voltage is induced to the restricting blade 45. Here, a current induced to the restricting blade 45 is measured, and then, the toner coat amount detecting circuit 55 measures an electrostatic capacity C2 generated between the developing sleeve 43 and the restricting blade 45. In other words, the developing sleeve 43 functions as an input electrode member, into which a detecting voltage is input. In contrast, the restricting blade 45 functions as an output electrode member for outputting, to a detecting circuit 57, the electrostatic capacity C2 according to the toner coat amount existing between the developing sleeve 43 and the restricting blade 45.

Here, explanation will be complementarily made on the relationship between the toner coat amount and the electrostatic capacity C2. The electrostatic capacity C2 generated between the developing sleeve 43 and the restricting blade 45 satisfies the expression: $C2=K\times A/d$, wherein A represents the area of the restricting blade 45; d, a distance between the developing sleeve 43 and the restricting blade 45; and K, a relative dielectric constant between the developing sleeve 43 and the restricting blade 45.

It is construed that the thin layer consisting of the toners is uniformly formed between the developing sleeve 43 and the restricting blade 45, and therefore, the relative dielectric constant K therebetween seems to be substantially fixed. In addition, the area A of the restricting blade 45 is not varied, and therefore, it is assumed to be fixed. On the other hand, the distance d depends on the toner coat amount borne on the developing sleeve 43. For example, the distance d is decreased when the toner amount coating the developing sleeve 43 is small, so that the electrostatic capacity C2 between the developing sleeve 43 and the restricting blade 45 becomes greater. In other words, the electrostatic capacity C2 depends on the toner coat amount, and therefore, is variable according to the toner coat amount.

With the above-described circuit configuration, the voltage induced to the restricting blade 45 after the application of the AC voltage (i.e., the detecting voltage) to the developing sleeve 43 is input into the detecting circuit 57 connected to the restricting blade 45 as a voltage V2 with respect to the electrostatic capacity C2. In the meantime, the AC voltage (i.e., the detecting voltage) output from the AC power source 51 is applied to a reference capacitor 56 (an electrostatic capacity C1 which is fixed), so that a voltage V1 is generated across the reference capacitor 56. The voltage V1 generated herein is input into the detecting circuit 57 in the same manner as the voltage V2.

The detecting circuit 57 produces a voltage V3 as a measurement value based on a difference between the voltages V1 and V2 and outputs the voltage V3 to a calculator 58, which digitally converts the voltage V3 as an analog voltage and, then, outputs the converted voltage to a controller 59. The controller 59 detects the toner coat amount on the developing sleeve 43 based on the voltage V digitally converted by the calculator 58 (hereinafter referred to as "a detection value (V)" in a unit of volt). In other words, the detecting circuit 57 can detect the toner coat amount in the original status. In this manner, the detector 55 detects the electrostatic capacity generated between the first electrode 43 and the second electrode 45, thereby detecting information on the toner coat amount (i.e., the amount of developer).

Figure 4:
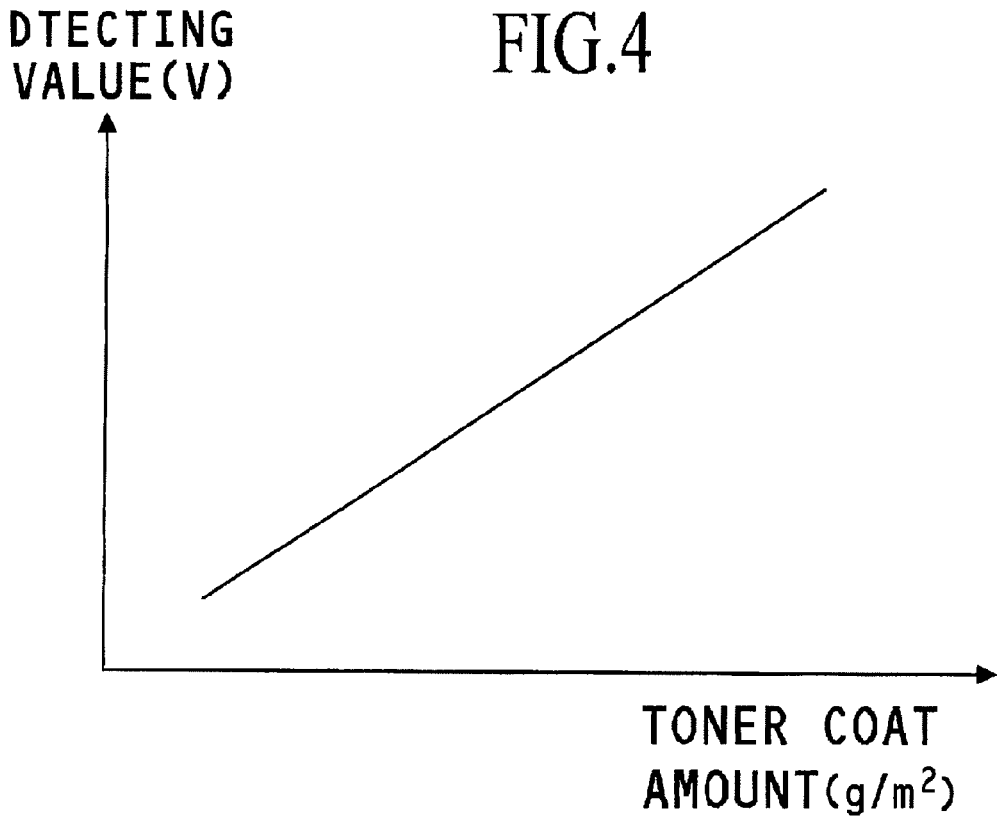
FIG. 4 is a graph illustrating the relationship between a detected value (V) and a toner coat amount (g/m2)

FIG. 4 illustrates the relationship between the detection value (V) and the toner coat amount (g/m2). As illustrated in FIG. 4, the detection value (V) and the toner coat amount (g/m2) are relevant to each other. As the toner coat amount is smaller (i.e., the electrostatic capacity C2 becomes greater), the detection value (V) becomes smaller. Incidentally, the controller 59 converts "the detection value (V)" "the toner coat amount (g/m2)" based on the previously given relationship therebetween. Specifically, with the above-described configuration, the controller 59 detects the toner coat amount based on "the detection value (V)", thereby deriving a target value of the blade voltage. For example, a second voltage value as a target value of the blade voltage in the case where the toner coat amount reaches a second amount smaller than a first amount is shifted toward the negative (minus) side (a side of a normally charged polarity of the toner) more than the first voltage value as a target value of the blade voltage at the time of the first amount. That is to say, in the case where the toner coat amount is reduced, a voltage for increasing the toner coat amount is derived as the target value of the blade voltage. In contrast, in the case where the toner coat amount is great, a reverse control is performed. As a consequence, the toner coat amount can be held at a proper value in consideration of the toner coat amount in the original status.

(Timing When Toner Coat Amount is Detected)

With the above-described circuit configuration (FIG. 3), there is a constraint that the restricting blade 45 cannot be utilized as the output electrode member during a period when the restricting blade 45 is used as the input electrode member; in contrast, the restricting blade 45 cannot be utilized as the input electrode member during a period when the restricting blade 45 is used as the output electrode member. This is because when the toner coat amount detecting circuit 55 is connected to the restricting blade 45 which applies the blade voltage, the value of the electrostatic capacity C2 cannot be correctly measured due to an influence of the applied blade voltage.

Figure 7:
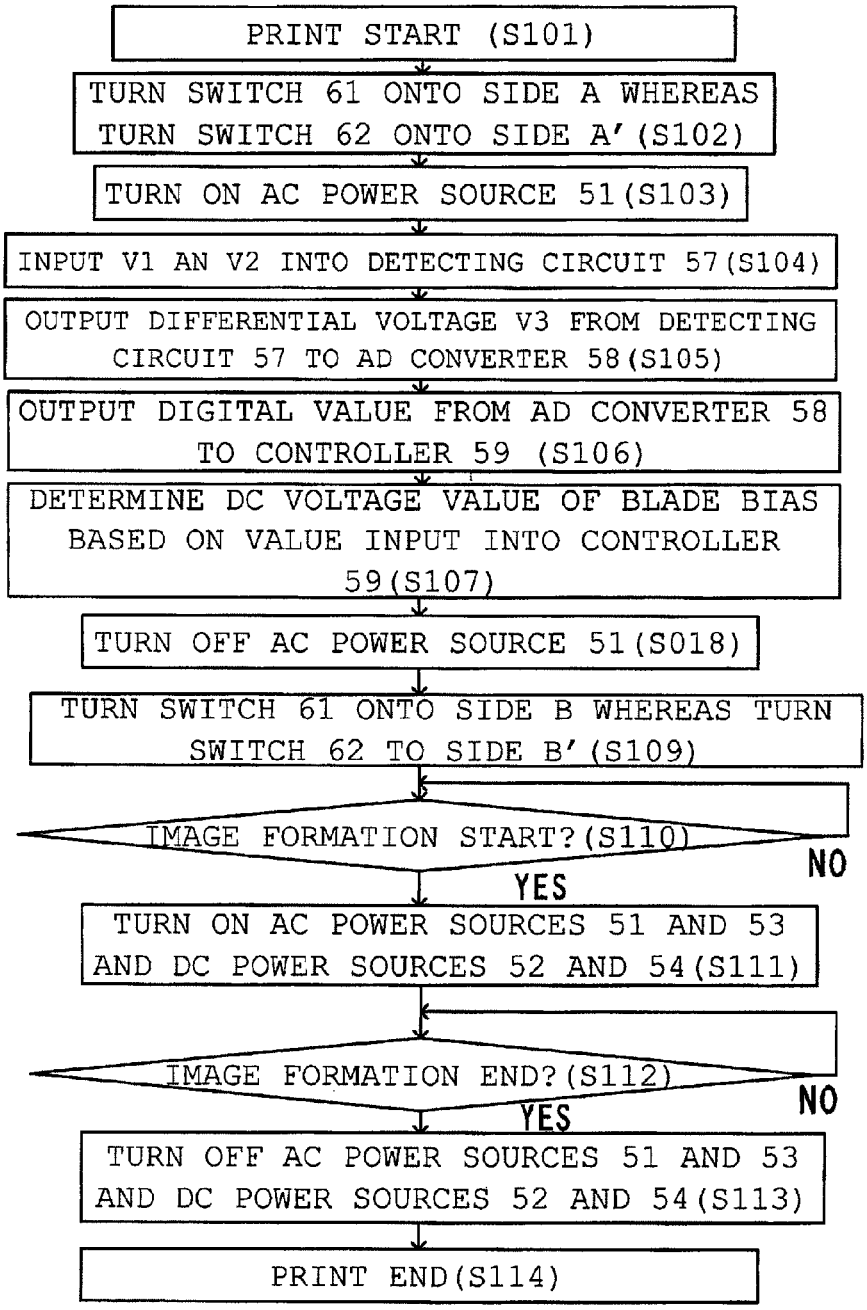
FIG. 7 is a flowchart illustrating a print operation in the first embodiment.

In order to solve this problem, it is necessary to detect the toner coat amount on the developing sleeve 43 during at least a period when the blade voltage is not applied, and then, to derive, as a target value, the DC voltage value (i.e., the DC component) of the blade voltage to be applied during image formation based on the detection result. Referring to FIG. 7, a description will be given below of a process after the input of a signal indicating print start until print end.

First, a host computer inputs a signal indicating "print start," thereby starting a main motor in an image forming apparatus (S101). Thereafter, the switches 61 and 62 are switched onto the sides A and A', respectively, thus achieving the connection with the AC power source and the detecting circuit required for detecting the toner coat amount (S102).

Next, the AC power source 51 applies the AC voltage to the developing sleeve 43 and the reference capacitor 56 (S103). At this time, the voltage V1 is generated across the reference capacitor 56 whereas the voltage V2 is generated in the restricting blade 45 (S104).

The detecting circuit 57 generates the voltage V3 as the measurement value based on the difference between the voltages V1 and V2, and then, outputs it to the AD converter 58 (S105). The AD converter 58 outputs the result of the digital conversion of the analog voltage V3 to the controller 59 (S106). The absolute value of the toner coat amount on the developing sleeve 43 can be detected based on the digital value input into the controller 59, and therefore, the DC voltage value (i.e., the target value) of the blade voltage for use in controlling the toner coat amount is derived according to the detection value (S107).

When the DC voltage value of the blade voltage is derived, the AC voltage temporarily applied by the AC power source 51 is stopped (S108). Then, the switches 61 and 62 are switched to the sides B and B', respectively, thus enabling the development voltage and the blade voltage required for an image forming operation to be applied (S109). Thereafter, upon input of a signal indicating "image formation start," the control routine proceeds to a next step (S110). Here, upon input of the signal indicating "image formation start", an electrostatic latent image formation is started.

When the image forming operation is started, the AC power source 51, the DC power source 52, the AC power source 53, and the DC power source 54 are actuated at predetermined timings, respectively, and then, the development voltage and the blade voltage are applied to the developing sleeve 43 and the restricting blade 45, respectively, thereby achieving the image forming operation (S111). Upon completion of the image forming operation (S112), the AC power source 51, the DC power source 52, the AC power source 53, and the DC power source 54 are stopped at predetermined timings, respectively (S113). Incidentally, if there is a difference in frequency of the AC voltages applied from the AC power source 51 and the AC power source 53, periodic gradation variations may occur on an image due to an interference. Therefore, the frequencies should be preferably equal to each other.

In this manner, in the present embodiment, at the time of non-image formation before the signal indicating "image formation start" is input, the original toner coat amount is detected, and then, the target value of the blade voltage at the time of image formation is derived based on the detection result. Here, "the time of the non-image formation" in the present embodiment signifies a period of time during which no image is formed on a sheet material in a state in which an apparatus body is installed. More particularly, it indicates a period during which no sheet material is transported to a nip portion defined between the photosensitive drum 2 and the transfer roller 7, that is, a period during which no blade voltage is applied to the restricting blade 45. In FIG. 7, for example, during a period from step S101 to step S109 (i.e., the period before the signal indicating "image formation start" is input) is referred to as "the time of the non-image formation". In contrast, "the time of image formation" signifies a period from step S110 to step S112 (i.e., a period after the signal indicating "image formation start" is input until a signal indicating "image formation end" is input), that is, a period during which the blade voltage is applied.

Although the voltage obtained by superimposing the DC voltage and the AD voltage one on another as the development voltage and the blade voltage is applied in the present embodiment, only the DC voltage as the development voltage and the blade voltage may form an image, thus producing the same effect as that produced in the present embodiment. In addition, "the AC voltage (i.e., the AC component)" may be replaced with "a vibration voltage" (unlike the AC voltage which requires the reverse of plus and minus polarities, the vibration voltage does not require any reverse of polarities, and therefore, a voltage value may be fluctuated in a vibration cycle).

Moreover, "the time of the non-image formation" described above may signify a period between an image formation job and a next image formation job when a plurality of image formation jobs are conducted, and further, may signify a timing of sheet feeding when images are sequentially formed. Alternatively, the timings may be combined, and then, the toner coat amount is detected before the image formation start. In the case where the number of sequential print sheets is large, the toner coat amount may be detected on the way of sheet feeding, to be reflected on controlling the toner coat amount at the time of image formation thereafter.

In view of the above, in the present embodiment, the toner coat amount on the developing sleeve 43 is detected, and then, the blade voltage is controlled based on the detection result, thereby suppressing the fluctuation in toner coat amount from adversely influencing a quality of an image. Thus, it is possible to provide the image forming apparatus capable of stably obtaining a good quality of an image from the beginning of use until the expiration of its lifetime.

[Second Embodiment]

Figure 8:
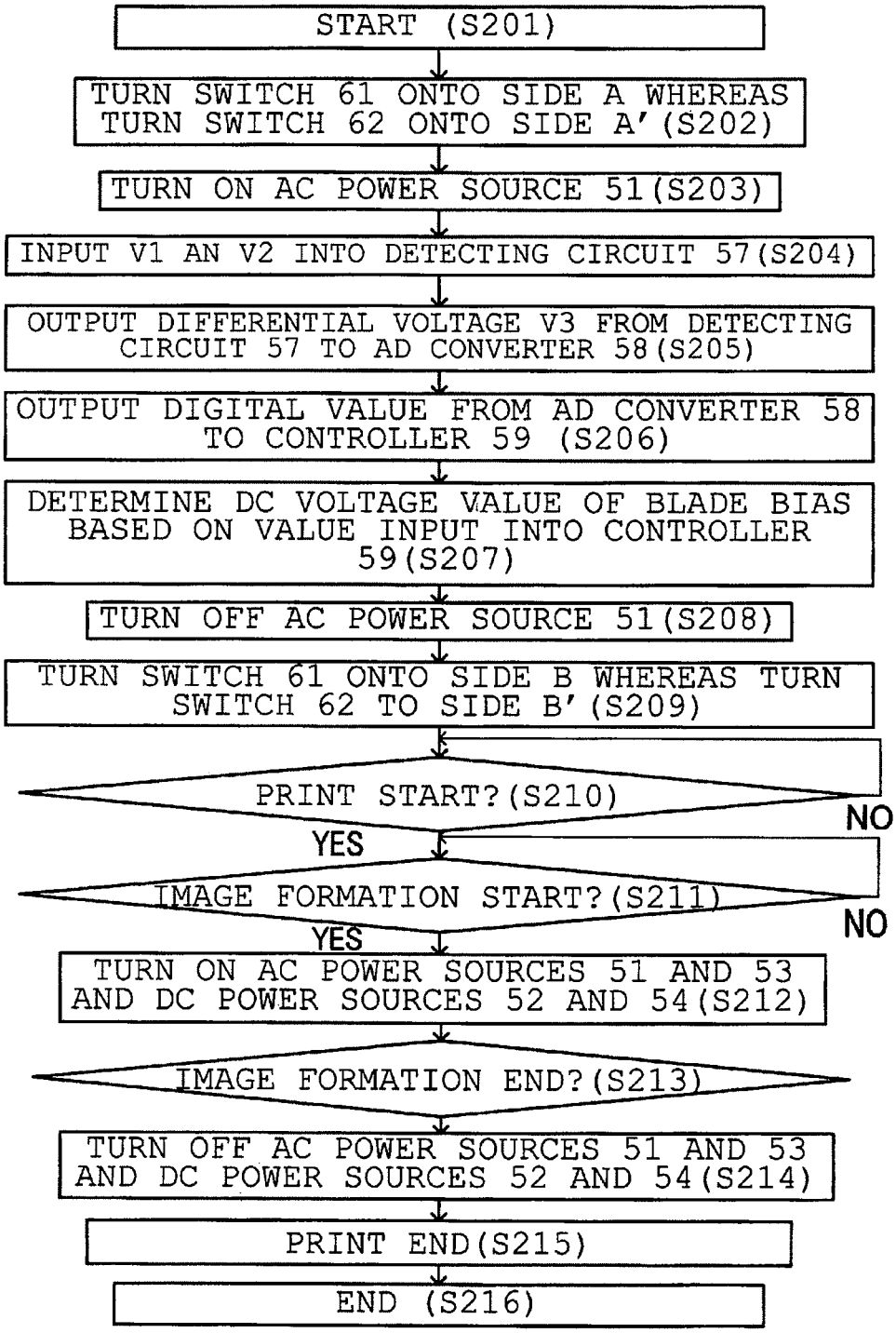
FIG. 8 is a flowchart illustrating a print operation in a second embodiment.

Referring to FIG. 8, a description will be given of an image forming apparatus according to a second embodiment of the present invention. The configuration of the image forming apparatus and the configuration of a toner coat amount detecting circuit are identical to those in the first embodiment, and therefore, their explanation will be omitted below.

As described in the first embodiment, the processes of detecting the toner coat amount in the original status and deriving the blade voltage based on the detection result are carried out "at the time of the non-image formation" in the image forming apparatus. In view of this, the present embodiment is featured in that a toner coat amount is detected and a target value of a blade voltage is derived "at the time of the non-image formation", that is, before a signal indicating "print start" is input, or during a period before a main motor in the image forming apparatus is driven.

As illustrated in FIG. 8, first, a signal indicating a toner coat amount detection start is input (S201), and then, the toner coat amount is detected and a blade voltage is determined (S202 to S209). Here, the process is identical to that described in the first embodiment, and therefore, its explanation will be omitted below. Next, a signal indicating "print start" is input (S210), and thereafter, a signal indicating "image formation start" is input (S211). Then, the control routine comes to an end through "image formation end (S213)" and "print end (S215)" in this order, thus completing a series of processes (S216).

With the above-described configuration, the signal indicating "image formation start" can be input immediately after the input of the signal indicating "print start", and therefore, a print time after the main motor is driven until an image is formed on a sheet material can be shortened. Thus, usability can be enhanced.

[Third Embodiment]

Figure 9A:
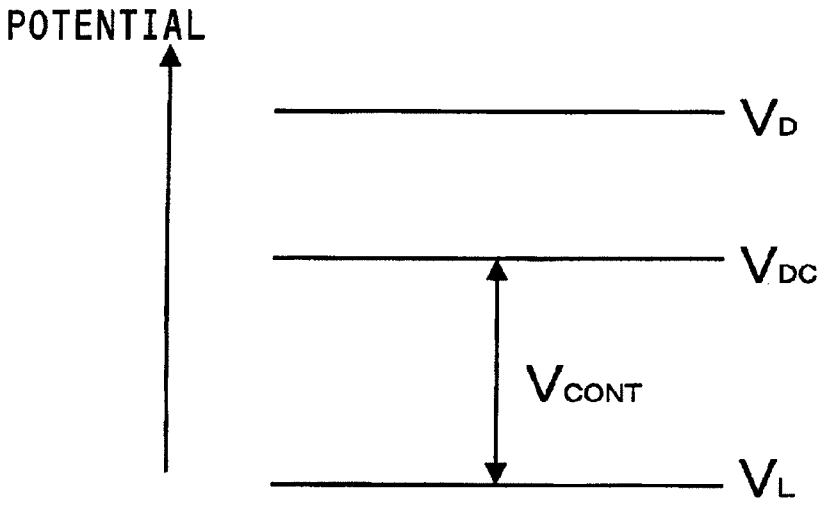
FIGS. 9A and 9B are graphs illustrating the relationship between a development voltage and a toner amount to be supplied.
Figure 9B:
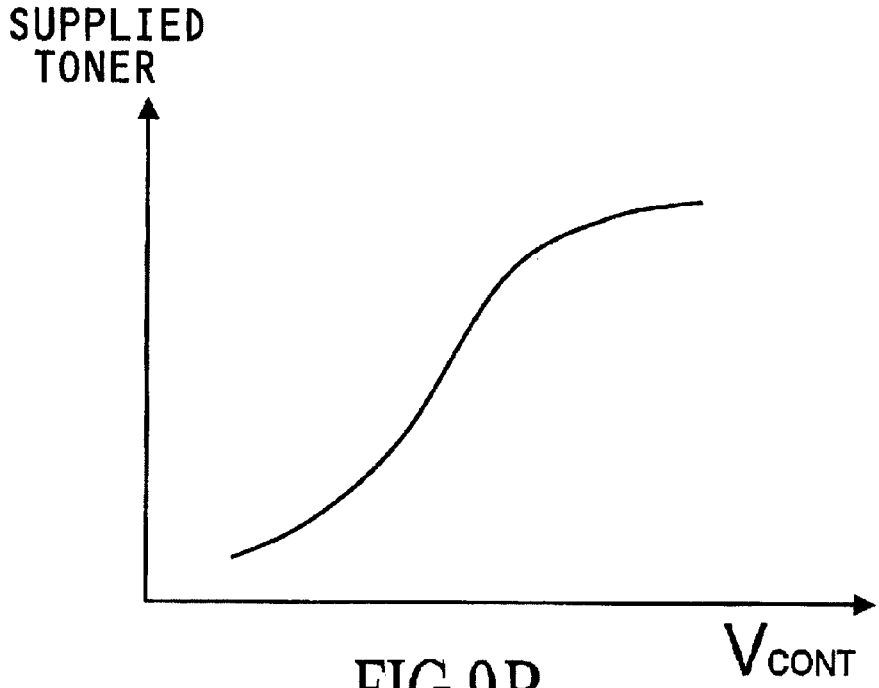
Figure 10:
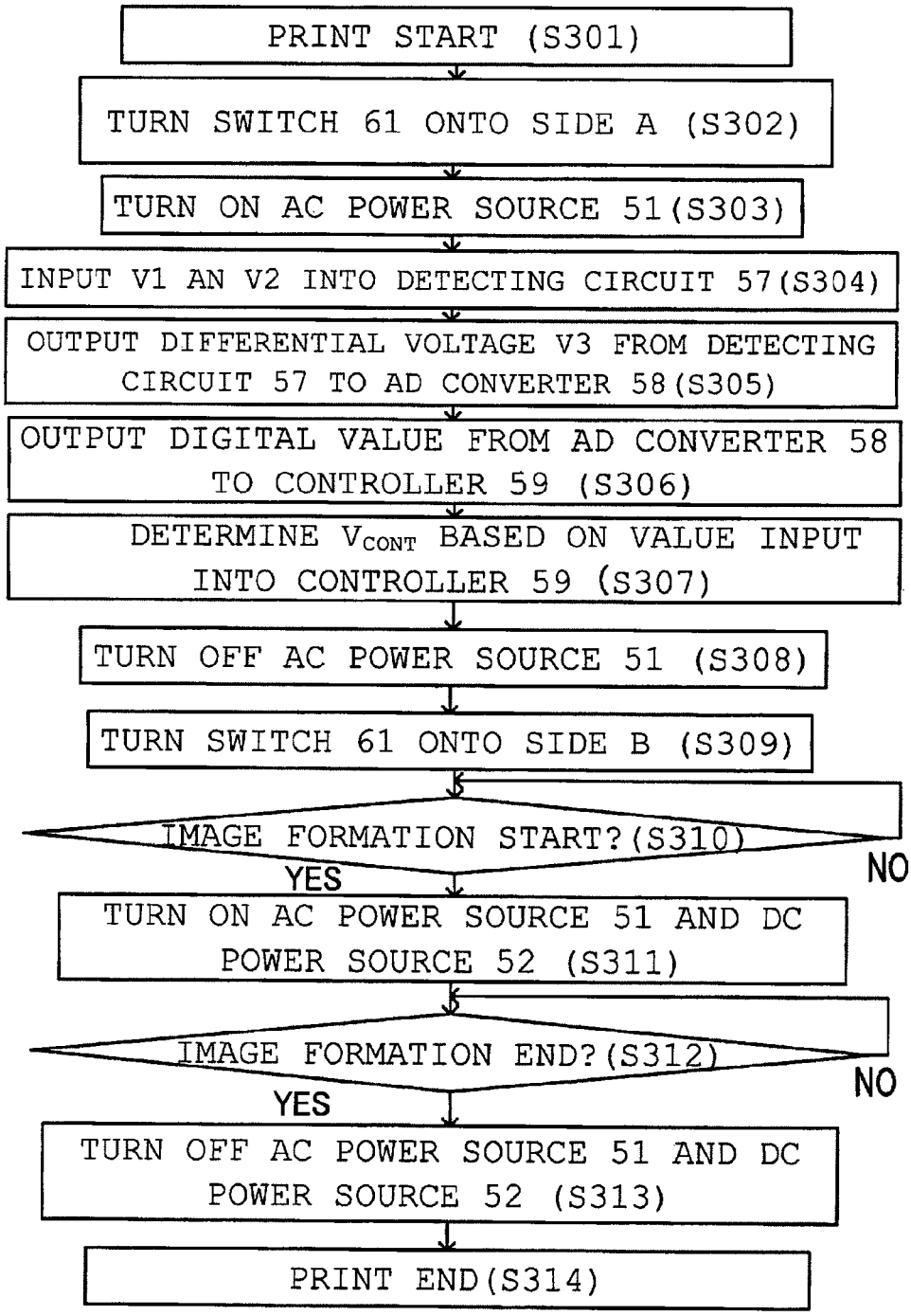
FIG. 10 is a flowchart illustrating a print operation in a third embodiment.
Figure 11:
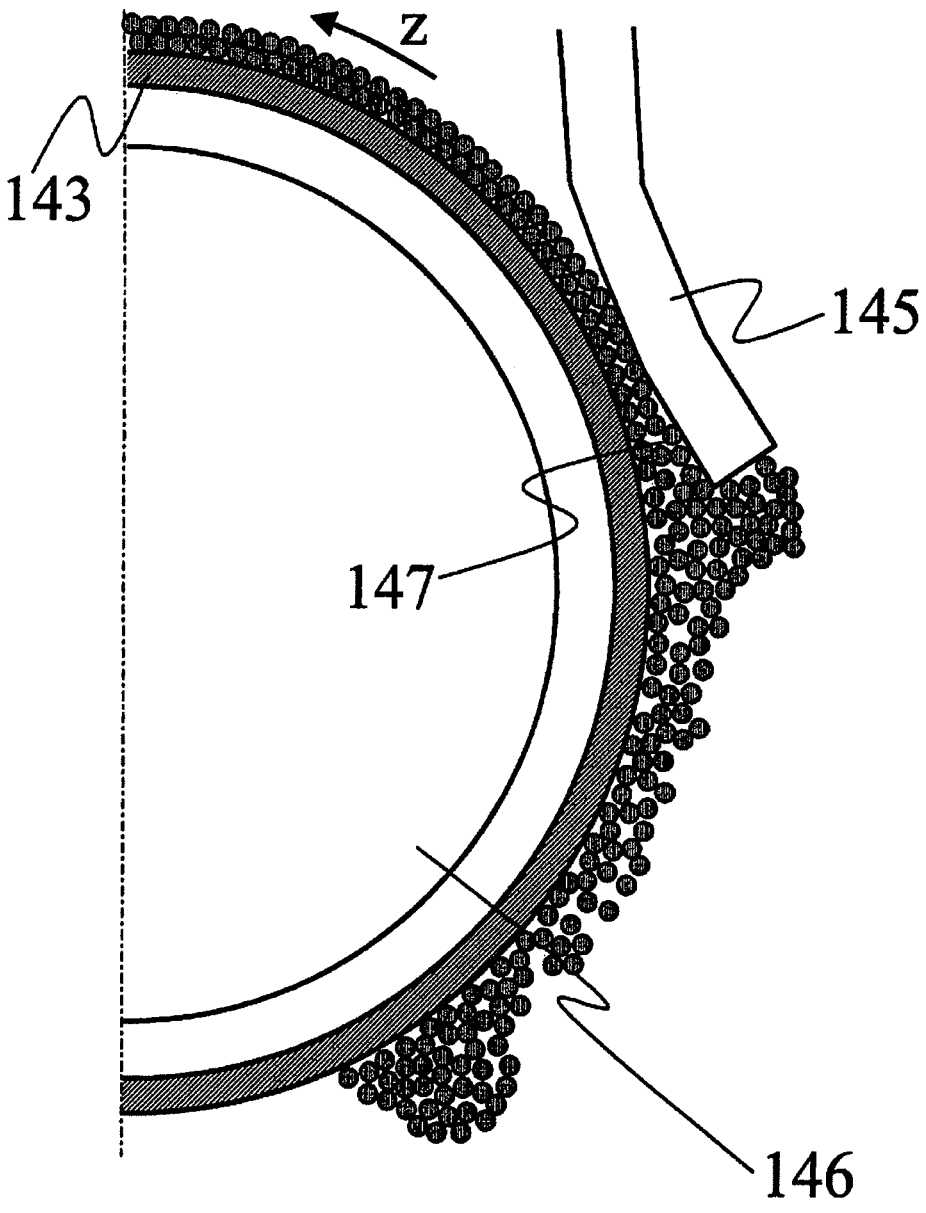
FIG. 11 is a view schematically showing the configurations of a developer bearing member and a restricting member in the prior art.

Referring to FIGS. 9 and 10, a description will be given of an image forming apparatus according to a third embodiment of the present invention. The configuration of the image forming apparatus and the configuration of a toner coat amount detecting circuit are identical to those in the first embodiment, and therefore, their explanation will be omitted below.

During the time of the non-image formation in the first and second embodiments, the toner coat amount is detected, and then, the blade voltage as the target value to be applied to the restricting blade 45 is derived based on the detection result. However, the present embodiment is featured by controlling a development voltage to be applied to a developing sleeve 43. In other words, the target value of the development voltage is derived depending on a fluctuation in toner coat amount, and then, the development voltage is controlled based on the target value.

In the present embodiment, a restricting blade 45 electrically functions as only an output electrode member. Therefore, it only requires at least a toner coat amount detecting circuit 55 to be connected to the restricting blade 45, and a switch 62, an AC power source 53, and DC power source 54 may be omitted.

Referring to FIGS. 9A and 9B, a description will be given of the relationship between a development voltage and a toner amount to be supplied accordingly. FIG. 9A illustrates the relationship between a potential ($V_D$, $V_L$) of a photosensitive drum 2 and a time average voltage ($V_{DC}$) of the development voltage. The surface of the photosensitive drum 2 is uniformly charged to the potential $V_D$ in a charging step, and a potential at a portion irradiated with a laser beam is changed from $V_D$ to $V_L$ by scanning and exposing by an exposing device 9, thus forming an electrostatic latent image. Here, $V_L$ represents a potential of the photosensitive drum 2 during so-called solid image formation during which an image is formed by lighting all of lasers.

In this state, when the development voltage $V_{DC}$ having the relationship of $V_D<V_{DC}<V_L$ is applied to the developing sleeve 43, a toner electrically charged to a negative polarity adheres only to a portion having a potential $V_L$ on the photosensitive drum 2. As illustrated in FIG. 9A, a difference between potentials $V_{DC}$ and $V_L$, that is, a difference between the potentials of the development voltage $V_{DC}$ and the potential ($V_L$) of the electrostatic image is referred to as a development contrast ($V_{CONT}$). FIG. 9B illustrates the relationship between the development contrast ($V_{CONT}$) and the toner amount to be supplied to the photosensitive drum 2. As illustrated in FIG. 9B, the greater the development contrast is, the more toner is to be supplied.

Next, referring to FIG. 10, a description will be given of processes for determining the development contrast ($V_{CONT}$) as a target value for image formation after a signal indicating "print start" is input.

First, a host computer inputs a signal indicating "print start", thereby starting a main motor in an image forming apparatus (S301). Thereafter, the switch 61 is switched onto the side A, thereby connecting the AC power source and the toner coat amount detecting circuit required for detecting the toner coat amount (S302).

Next, the AC power source 51 applies an AC voltage (i.e., a detecting voltage) to the developing sleeve 43 and the reference capacitor 56 (S303). At this time, a voltage V1 is generated across the reference capacitor 56 whereas a voltage V2 is generated in the restricting blade 45 (S304).

The detecting circuit 57 generates a voltage V3 as a measurement value based on the difference between the voltages V1 and V2, and then, outputs it to an AD converter 58 (S305). The AD converter 58 outputs the result of the digital conversion of the analog voltage V3 to a controller 59 (S306). The absolute value of the toner coat amount on the developing sleeve 43 can be detected based on the digital value input into the controller 59, and therefore, the development contrast VCONT required for an image forming operation is derived according to the detection value, thus determining the development voltage which can achieve the development contrast (S307). The development voltage should be determined to a voltage where the smaller the detected toner coat amount is, the greater the development contrast $V_{CONT}$ becomes. Specifically, assuming that a development voltage when the toner coat amount is a first amount is referred to as a first voltage whereas a development voltage when the toner coat amount is a second amount smaller than the first amount is referred to as a second voltage, the second voltage is a value having a greater potential difference from a potential of an electrostatic image than the first voltage. As a consequence, even if the toner coat amount is reduced, the development voltage capable of increasing the development contrast is applied to the developing sleeve, thereby suppressing any decrease in image density.

When the development voltage is determined, the AC voltage applied by the AC power source 51 is temporarily stopped (S308). And then, the switch 61 is turned onto the side B, thus enabling the development voltage required for an image forming operation to be applied (S309). Thereafter, upon input of a signal indicating "image formation start", the control routine proceeds to a next step (S310). Here, upon input of the signal indicating "image formation start", an electrostatic latent image formation is started.

When the image forming operation is started, the AC power source 51 and the DC power source 52 are actuated at predetermined timings, respectively, and then, the determined development voltage is applied to the developing sleeve 43, thereby achieving the image forming operation (S311). Upon completion of the image forming operation (S312), the AC power source 51 and the DC power source 52 are stopped at predetermined timings, respectively (S313).

In view of the above, in the present embodiment, the toner coat amount on the developing sleeve 43 is detected, and then, the development voltage is controlled based on the detection result, thereby suppressing the fluctuation in toner coat amount from adversely influencing a quality of an image. Thus, it is possible to provide the image forming apparatus capable of stably obtaining a good quality of an image from the beginning of use until the expiration of its lifetime.

The timing at which the toner coat amount on the developing sleeve 43 is detected and the development contrast is determined may be anytime even during "the time of the non-image formation", for example, may be a timing during sheet feeding or a timing before the signal indicating "print start" is input described in the above-described first and second embodiments. Moreover, the control of the blade bias described in the above-described first and second embodiments may be combined with the control of the development voltage in the present embodiment.

(Other Embodiments)

Although the AC voltage (i.e., the detecting voltage) is applied to the developing sleeve 43 and the reference capacitor 56 in detecting the toner coat amount in the above-described first to third embodiments, the detecting voltage may be applied to the restricting blade 45. In this case, the toner coat amount can be detected by measuring a current induced in the developing sleeve 43 in the same manner as the first to third embodiments described above. In other words, the detecting voltage is applied to either one of the developing sleeve 43 and the restricting blade 45, and then, the current induced in the other one may be measured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-140346, filed on Jun. 11, 2009, and Japanese Patent Application No. 2010-077906, filed on Mar. 30, 2010, which are hereby incorporated by reference herein in their entirety.

What is claimed is:

1. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the restricting member during image formation, based on a result detected by the detector, wherein the detector performs a detecting operation during a non-developing duration.

2. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member;

a controller which can change a value of a voltage to be applied to the restricting member during image formation, based on a result detected by the detector; and a motor for driving the developing device, wherein the detector performs the detecting operation before the motor starts driving.

3. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the restricting member during image formation, based on a result detected by the detector, wherein the detector is configured to detect an electrostatic capacity between a first electrode disposed in the developer bearing member and a second electrode disposed in the restricting member by applying a vibration voltage to either one of the developer bearing member and the restricting member.

4. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the restricting member during image formation, based on a result detected by the detector, wherein assuming that a first voltage represents a voltage to be applied to the restricting member when the amount of developer existing between the developer bearing member and the restricting member is equal to a first amount whereas a second voltage represents a voltage to be applied to the restricting member when the amount of developer existing between the developer bearing member and the restricting member is equal to a second amount smaller than the first amount, the second voltage is a value shifted toward a side of a normally charged polarity of the developer from a value of the first voltage.

5. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the developer bearing member during image formation, based on a result detected by the detector, wherein the detector performs a detecting operation during a non-developing duration.

6. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member;

a controller which can change a value of a voltage to be applied to the developer bearing member during image formation, based on a result detected by the detector; and a motor for driving the developing device, wherein the detector performs the detecting operation before the motor starts driving.

7. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the developer bearing member during image formation, based on a result detected by the detector, wherein the detector is configured to detect an electrostatic capacity between a first electrode disposed in the developer bearing member and a second electrode disposed in the restricting member by applying a vibration voltage to either one of the developer bearing member and the restricting member.

8. A developing device which develops an electrostatic image with a developer comprising:

a developer bearing member for bearing the developer so as to develop the electrostatic image;

a restricting member for restricting the amount of developer borne on the developer bearing member;

a detector for detecting information on the amount of developer existing between the developer bearing member and the restricting member; and a controller which can change a value of a voltage to be applied to the developer bearing member during image formation, based on a result detected by the detector, wherein assuming that a first voltage represents a voltage to be applied to the developer bearing member when the amount of developer existing between the developer bearing member and the restricting member is equal to a first amount whereas a second voltage represents a voltage to be applied to the developer bearing member when the amount of developer existing between the developer bearing member and the restricting member is equal to a second amount smaller than the first amount, the second voltage is a value having a larger potential difference with respect to a potential of the electrostatic image than the first voltage.

* * * * *